US008863525B2

(12) United States Patent
Toronto et al.

(10) Patent No.: US 8,863,525 B2
(45) Date of Patent: Oct. 21, 2014

(54) COMBUSTOR WITH FUEL STAGGERING FOR FLAME HOLDING MITIGATION

(75) Inventors: David Kaylor Toronto, Greenville, SC (US); Kwanwoo Kim, Mason, OH (US); Abdul Rafey Khan, Greenville, SC (US); Luis Flamand, Greenville, SC (US)

(73) Assignee: General Electric Company, Schenectady, NY (US)

( * ) Notice: Subject to any disclaimer, the term of this patent is extended or adjusted under 35 U.S.C. 154(b) by 952 days.

(21) Appl. No.: 12/983,342

(22) Filed: Jan. 3, 2011

(65) Prior Publication Data

US 2012/0167544 A1 Jul. 5, 2012

(51) Int. Cl.

| | |
|---|---|
| ***F23R 3/12*** | (2006.01) |
| ***F23R 3/14*** | (2006.01) |
| ***F23R 3/60*** | (2006.01) |
| ***F23R 3/34*** | (2006.01) |
| ***F23R 3/28*** | (2006.01) |
| ***F23R 3/16*** | (2006.01) |

(52) U.S. Cl.

CPC ..... *F23R 3/346* (2013.01); *F23D 2900/14021* (2013.01); *F23R 3/286* (2013.01); *F23R 3/16* (2013.01); *F23R 2900/03045* (2013.01); *F23D 2900/14004* (2013.01)

USPC ..... 60/737; 60/760; 60/749

(58) Field of Classification Search

USPC ..... 60/749, 750, 746, 760, 734, 737, 739, 60/740, 39.11, 723, 777

See application file for complete search history.

(56) References Cited

U.S. PATENT DOCUMENTS

| | | | |
|---|---|---|---|
| 4,067,190 | A | 1/1978 | Hamm et al. |
| 4,292,801 | A | 10/1981 | Wilkes et al. |
| 4,356,698 | A | 11/1982 | Chamberlain |
| 4,838,029 | A | 6/1989 | Gleason et al. |
| 4,845,952 | A | 7/1989 | Beebe |
| 4,966,001 | A | 10/1990 | Beebe |
| 5,203,796 | A | 4/1993 | Washam et al. |
| 5,220,787 | A | 6/1993 | Bulman |
| 5,251,447 | A | 10/1993 | Joshi et al. |
| 5,351,477 | A | 10/1994 | Joshi et al. |
| 5,365,738 | A | 11/1994 | Etheridge |
| 5,372,008 | A | 12/1994 | Sood |
| 5,408,830 | A | 4/1995 | Lovett |
| 5,452,574 | A | 9/1995 | Cowell et al. |
| 5,477,671 | A | 12/1995 | Mowill |
| 5,481,866 | A | 1/1996 | Mowill |
| 5,572,862 | A | 11/1996 | Mowill |
| 5,613,357 | A | 3/1997 | Mowill |
| 5,622,054 | A | 4/1997 | Tingle |
| 5,628,182 | A | 5/1997 | Mowill |
| 5,638,674 | A | 6/1997 | Mowill |
| 5,647,215 | A | 7/1997 | Sharifi et al. |
| 5,675,971 | A | 10/1997 | Angel et al. |
| 5,699,667 | A | 12/1997 | Joos |

(Continued)

*Primary Examiner* — Andrew Nguyen

(74) *Attorney, Agent, or Firm* — Sutherland Asbill & Brennan LLP

(57) ABSTRACT

The present application provides a combustor. The combustor may include an air flow path with a flow of air therein. A flow obstruction may be positioned within the air flow path and cause a wake or a recirculation zone downstream thereof. A number of fuel injectors may be positioned downstream of the flow obstruction. The fuel injectors may inject a flow of fuel into the air flow path such that the flows of fuel and air in the wake or the recirculation zone do not exceed a flammability limit.

10 Claims, 4 Drawing Sheets

(56) References Cited

U.S. PATENT DOCUMENTS 5,727,378 A 3/1998 Seymour
5,755,090 A 5/1998 Hu
5,765,363 A 6/1998 Mowill
5,778,676 A 7/1998 Joshi et al.
5,791,889 A 8/1998 Gemmen et al.
5,816,049 A 10/1998 Joshi
5,822,992 A 10/1998 Dean
5,829,967 A * 11/1998 Chyou ..... 431/350
5,862,668 A 1/1999 Richardson
5,895,211 A 4/1999 McMillan
5,899,074 A 5/1999 Komatsu et al.
5,901,555 A * 5/1999 Mandai et al. ..... 60/747
5,918,465 A 7/1999 Schmid
5,927,076 A 7/1999 Pillsbury
5,946,904 A 9/1999 Boehnlein et al.
6,003,299 A 12/1999 Idleman
6,047,550 A 4/2000 Beebe
6,070,410 A 6/2000 Dean
6,070,411 A 6/2000 Iwai et al.
6,082,111 A 7/2000 Stokes
6,101,814 A 8/2000 Hoke et al.
6,176,087 B1 1/2001 Sayder et al.
6,192,688 B1 2/2001 Beebe
6,282,904 B1 9/2001 Kraft et al.
6,286,298 B1 9/2001 Burrus et al.
6,295,801 B1 10/2001 Burrus et al.
6,311,473 B1 11/2001 Benjamin et al.
6,327,860 B1 12/2001 Critchley
6,405,522 B1 6/2002 Pont et al.
6,425,240 B1 7/2002 Park
6,438,937 B1 8/2002 Pont et al.
6,438,959 B1 8/2002 Dean et al.
6,442,939 B1 9/2002 Stuttaford et al.
6,446,439 B1 9/2002 Kraft et al.
6,453,658 B1 9/2002 Willis et al.
6,460,339 B2 10/2002 Nishida et al.
6,513,329 B1 2/2003 Snyder et al.
6,684,642 B2 2/2004 Willis et al.
6,691,516 B2 2/2004 Stuttaford et al.
6,701,964 B1 3/2004 Maurice
6,715,292 B1 4/2004 Hoke
6,722,132 B2 4/2004 Stuttaford et al.
6,755,024 B1 6/2004 Mao et al.
6,786,040 B2 9/2004 Boehnlein et al.
6,868,676 B1 3/2005 Haynes
6,898,937 B2 5/2005 Stuttaford et al.
6,908,303 B1 6/2005 Oda et al.
6,915,636 B2 7/2005 Stuttaford et al.
6,931,853 B2 8/2005 Dawson
6,935,116 B2 * 8/2005 Stuttaford et al. ..... 60/737
6,945,051 B2 9/2005 Benelli et al.
6,966,187 B2 11/2005 Modi et al.
6,986,254 B2 1/2006 Stuttaford et al.
6,993,916 B2 2/2006 Johnson et al.
7,089,745 B2 8/2006 Roby et al.
7,093,445 B2 8/2006 Corr, II et al.
7,111,449 B1 9/2006 Stebbings
7,117,679 B2 10/2006 Toon et al.
7,137,809 B2 11/2006 Bueche et al.
7,143,583 B2 12/2006 Hayashi et al.
7,194,382 B2 3/2007 Lieuwen
7,198,483 B2 4/2007 Bueche et al.
7,241,138 B2 7/2007 Flohr et al.
7,322,198 B2 1/2008 Roby et al.
7,373,778 B2 * 5/2008 Bunker et al. ..... 60/752
7,621,130 B2 11/2009 Ceccherini et al.
7,707,833 B1 5/2010 Bland et al.
2001/0049932 A1 12/2001 Beebe
2002/0069645 A1 6/2002 Mowill
2002/0076668 A1 6/2002 Venizelos et al.
2002/0083711 A1 7/2002 Dean et al.
2002/0104316 A1 8/2002 Dickey et al.
2002/0129609 A1 9/2002 Pont et al.
2002/0148229 A1 10/2002 Pont et al.
2002/0148231 A1 10/2002 Willis et al.
2002/0148232 A1 10/2002 Willis et al.
2002/0162333 A1 11/2002 Zelina
2003/0089111 A1 5/2003 Benelli et al.
2003/0131600 A1 7/2003 David et al.
2003/0154720 A1 8/2003 Boehnlein et al.
2004/0006990 A1 1/2004 Stuttaford et al.
2004/0006991 A1 1/2004 Stuttaford et al.
2004/0006992 A1 1/2004 Stuttaford et al.
2004/0006993 A1 1/2004 Stuttaford et al.
2004/0021235 A1 2/2004 Corr, II et al.
2004/0035114 A1 2/2004 Hayashi et al.
2004/0093851 A1 5/2004 Dawson
2004/0211186 A1 10/2004 Stuttaford et al.
2004/0226300 A1 11/2004 Stuttaford et al.
2005/0000487 A1 1/2005 Baalke et al.
2006/0257807 A1 11/2006 Hicks et al.
2007/0033945 A1 2/2007 Goldmeer et al.
2007/0107436 A1 5/2007 Evulet
2007/0151248 A1 7/2007 Scarinci et al.
2007/0202449 A1 8/2007 Godon
2007/0227147 A1 10/2007 Cayre et al.
2008/0000234 A1 1/2008 Commaret et al.
2008/0078182 A1 4/2008 Evulet
2008/0104961 A1 5/2008 Bunker
2008/0110173 A1 5/2008 Bunker
2009/0111063 A1 4/2009 Boardman et al.
2010/0011771 A1 1/2010 Evulet et al.
2010/0064691 A1 * 3/2010 Laster et al. ..... 60/737
2011/0016869 A1 * 1/2011 Iwasaki ..... 60/752

* cited by examiner

COMBUSTOR WITH FUEL STAGGERING FOR FLAME HOLDING MITIGATION

TECHNICAL FIELD

The present application relates generally to gas turbine engines and more particularly relates to a combustor with fuel staggering and/or fuel injector staggering for flame holding mitigation due to local flow obstructions and other types of flow disturbances.

BACKGROUND OF THE INVENTION

In a gas turbine engine, operational efficiency generally increases as the temperature of the combustion stream increases. Higher combustion stream temperatures, however, may produce higher levels of nitrogen oxides ("$NO_x$") and other types of emissions. Such emissions may be subject to both federal and state regulation in the United States and also subject to similar regulations abroad. A balancing act thus exists between operating the gas turbine engine in an efficient temperature range while also ensuring that the output of $NO_x$ and other types of regulated emissions remain below the mandated levels.

Several types of known gas turbine engine designs, such as those using Dry Low $NO_x$ ("DLN") combustors, generally premix the fuel flows and the air flows upstream of a reaction or a combustion zone so as to reduce $NO_x$ emissions via a number of premixing fuel nozzles. Such premixing tends to reduce overall combustion temperatures and, hence, $NO_x$ emissions and the like.

Premixing, however, may present several operational issues such as flame holding, flashback, auto-ignition, and the like. These issues may be a particular concern with the use of highly reactive fuels. For example, given an ignition source, a flame may be present in the head-end of a combustor upstream of the fuel nozzles with any significant fraction of hydrogen or other types of fuels. Any type of fuel rich pocket thus may sustain a flame and cause damage to the combustor.

Other premixing issues may be due to irregularities in the fuel flows and the air flows. For example, there are several flow obstructions that may disrupt the flow through an incoming pathway between a flow sleeve and a liner. With a combustor having fuel injector vanes that inject fuel into the airflow upstream of the head-end, these flow disturbances may create flow recirculation zones on the trailing edge of the vanes. These recirculation zones may lead to stable pockets of ignitable fuel-air mixtures that can in turn lead to flame holding or other types of combustion events given an ignition source.

There is thus a desire for an improved combustor design. Such a design should accommodate flow disturbances upstream of the fuel injectors so as to avoid flame holding, flashback, auto-ignition, and the like. Moreover, an increase in the flame holding margin may allow the use of higher reactivity fuels for improved performance and emissions.

SUMMARY OF THE INVENTION

The present application thus provides a combustor. The combustor may include an air flow path with a flow of air therein. A flow obstruction may be positioned within the air flow path and cause a wake or a recirculation zone downstream thereof. A number of fuel injectors may be positioned downstream of the flow obstruction. The fuel injectors may inject a flow of fuel into the air flow path such that the flows of fuel and air in the wake or the recirculation zone do not exceed a flammability limit.

The present application further provides a combustor. The combustor may include an air flow path with a flow of air therein. A flow obstruction may be positioned within the air flow path and cause a wake or a recirculation zone downstream thereof. A number of fuel injectors may be positioned downstream of the flow obstruction. The fuel injectors may be positioned outside of the wake or the recirculation zone.

The present application further provides a combustor. The combustor may include an air flow path with a flow of air therein. A flow obstruction may be positioned within the air flow path and cause a wake or a recirculation zone downstream thereof. A number of fuel injectors may be positioned downstream of the flow obstruction. One or more of the fuel injectors may be downstream fuel injectors positioned downstream of but in line with the wake or the recirculation zone.

These and other features and improvements of the present application will become apparent to one of ordinary skill in the art upon review of the following detailed description when taken in conjunction with the several drawings and the appended claims.

DETAILED DESCRIPTION

Figure 1:
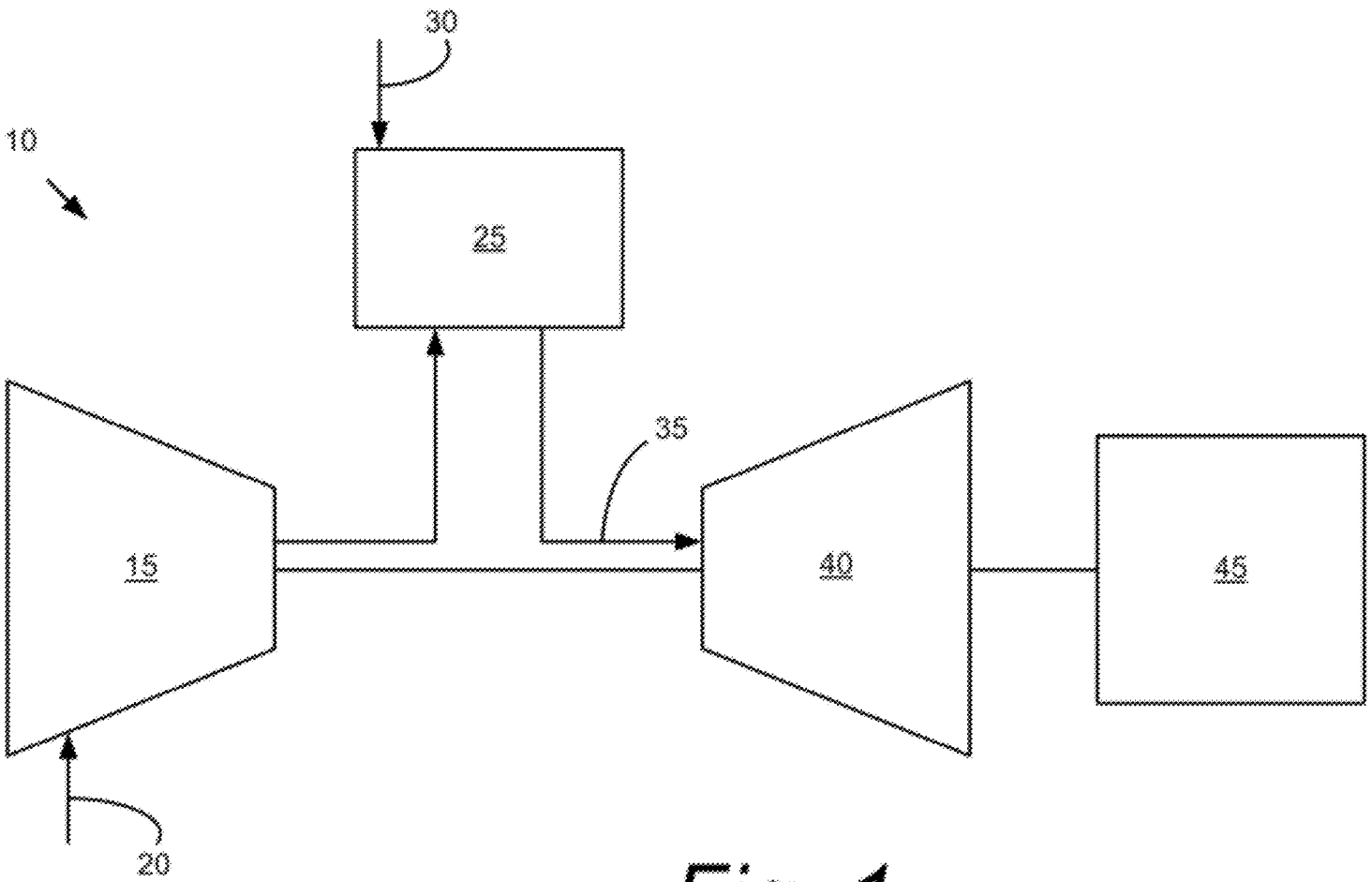
FIG. 1 is a schematic view of a known gas turbine engine as may be used herein.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor delivers the compressed flow of air 20 to a combustor 25. The combustor 25 mixes the compressed flow of air 20 with a compressed flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 and an external load 45 such as an electrical generator and the like.

The gas turbine engine 10 may use natural gas, various types of syngas, and/or other types of fuels. The gas turbine engine 10 may be anyone of a number of different gas turbine engines offered by General Electric Company of Schenectady, N.Y., including those such as a heavy duty 9FA gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
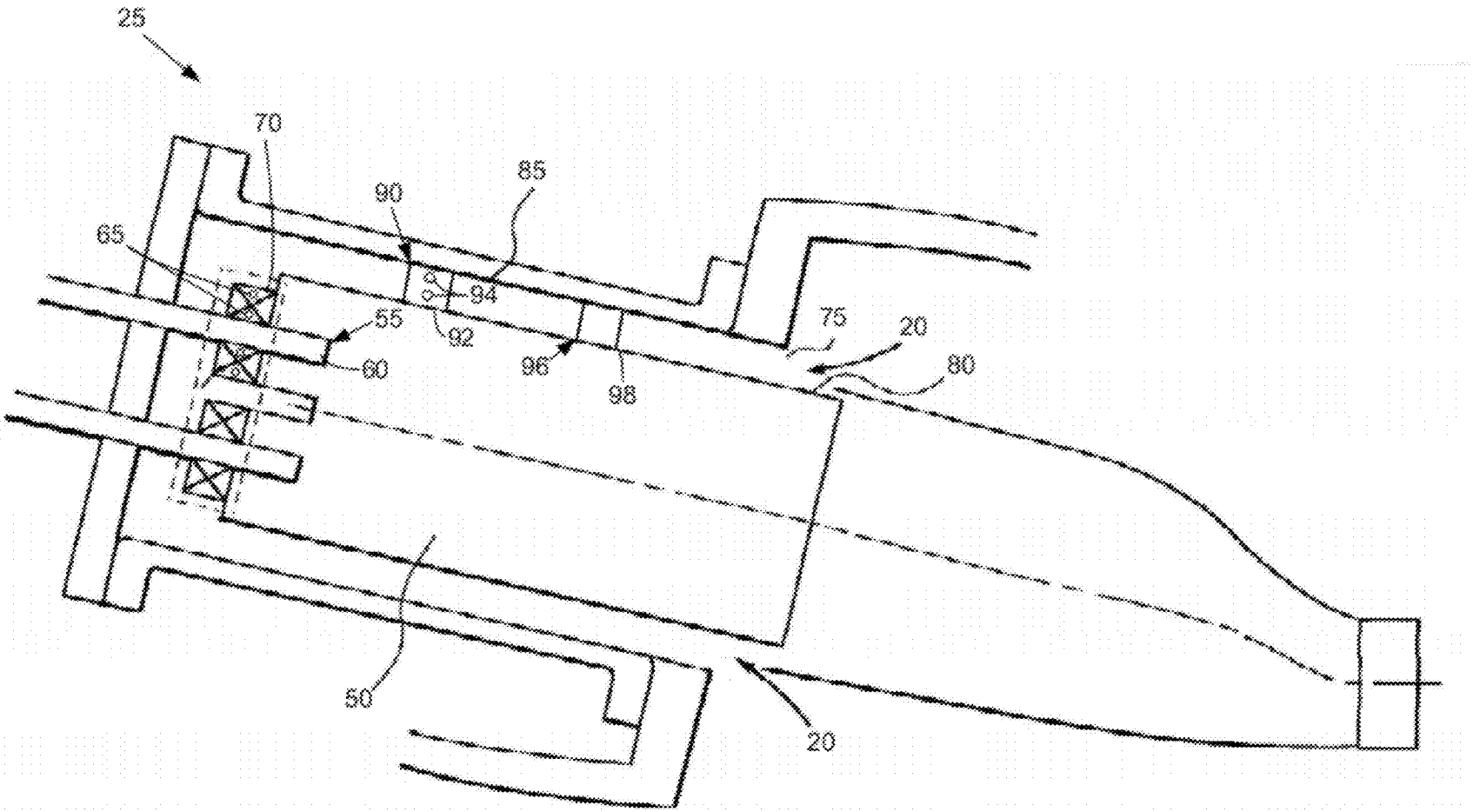
FIG. 2 is a side cross-sectional view of a known combustor.

FIG. 2 shows a simplified example of a known combustor 25 that may be used with the gas turbine engine 10. Generally described, the combustor 25 may include a combustion chamber 50 with a number of fuel nozzles 55 positioned therein. Each of the fuel nozzles 55 may include a central fuel passage 60 generally for a liquid fuel. The fuel nozzles 55 also may include a number of fuel injectors 65. The fuel injectors 65 may be positioned about one or more swirlers 70. The swirlers 70 aid in the premixing of the flow of air 20 and the flows of fuel 30 therein. The fuel injectors 65 may be used with premix fuel and the like. Other types of fuels and other types of fuel circuits may be used herein.

The flow of air 20 may enter the combustor 25 from the compressor 15 via an incoming air path 75. The incoming air path 75 may be defined between a liner 80 of the combustion chamber 50 and an outer casing 85. The flow of air 20 may travel along the incoming air path 75 and then reverse direction about the fuel nozzles 55. The flow of air 20 and the flow of fuel 30 may be ignited downstream of the fuel nozzles 55 within the combustion chamber 50 such that the flow of the combustion gases 35 may be directed towards the turbine 40. Other configurations and other components may be used herein.

The combustor 25 also may have a lean pre-nozzle fuel injection system 90 positioned about the incoming air path 75 between the liner 80 and the casing 85. The lean pre-nozzle fuel injection system 90 may have a number of fuel pegs or fuel injectors 92. The fuel injectors 92 may have an aerodynamic airfoil or streamline shape. Other shapes may be used herein. The fuel injectors 92 each may have a number of injector holes 94 therein. The number and positioning of the fuel injectors 92 and the injection holes 94 may be optimized for premixing. A premix fuel or other types of fuel flows 30 may be used therein.

As described above, a number of flow obstructions 96 also may be positioned within the incoming air path 75. These flow obstructions 96 may be structures such as a number of crossfire tubes 98. Other types of obstructions 96 may include liner penetrations, liner stops, and the like. These flow obstructions 96 may create a low velocity wake or a low or negative velocity recirculation zone. The wake or the recirculation zone may envelop one or more of the fuel injectors 92 and/or create other types of local flow disturbances. A flow of the fuel 30 from the holes 94 of the fuel injectors 92 thus may be pulled upstream within the wake or recirculation zone. Although these flow obstructions 96 may cause these flow disturbances, the structures are otherwise required for efficient combustor operation.

Figure 3:
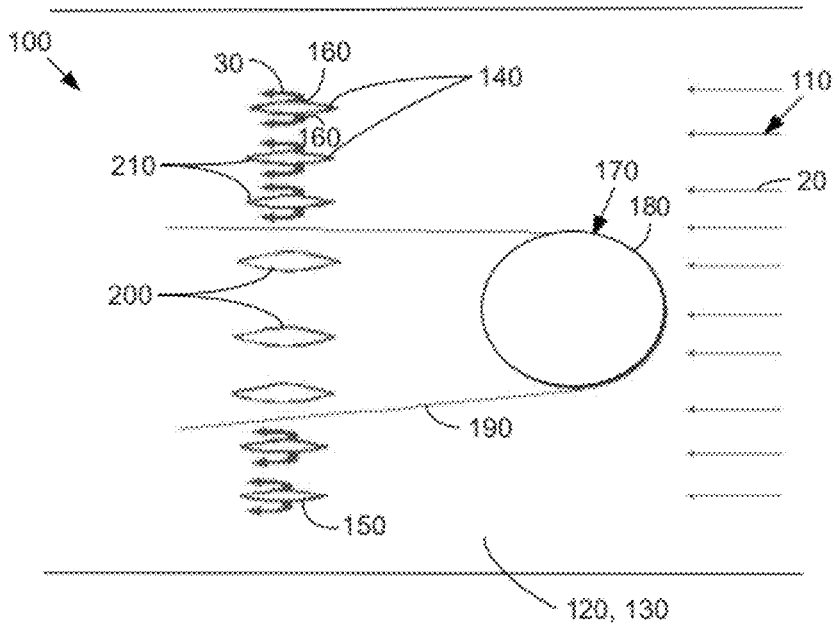
FIG. 3 is a partial schematic view of a combustor as may be described herein.

FIG. 3 shows portions of a combustor 100 as may be described herein. Specifically, an air path 110 may be configured between a liner 120 and a casing 130. The air path 110 also may be configured between other structures. The combustor 100 may include a number of fuel pegs or fuel injectors 140 positioned in the air path 110. The fuel injectors 140 likewise may have an aerodynamic airfoil or streamlined shape 150 to optimize flame holding resistance. Other shapes may be used herein. Any number of the fuel injectors 140 may be used in any size or position. The fuel injectors 140 each may have a number of injector holes 160 therein. The injector holes 160 may be on one or both sides of the fuel injectors 140. Any number of the injector holes 160 may be used in any size or position. Other configurations and other components may be used herein.

The air path 110 also may include one or more flow obstructions 170 therein. The flow obstructions 170 may be a crossfire tube 180 or any other type of flow obstruction including liner penetrations, liner stops, and the like. The flow obstruction may be any structure that may create a flow disturbance in the flow of air 20. The flow disturbance may be a wake or other type of region with a reduced or negative velocity that may serve as a wake or a recirculation zone 190 and the like.

In this example, the fuel injectors 140 may include a number of unfueled fuel injectors 200 positioned downstream of the flow obstruction 170 in the wake or the recirculation zone 190 thereof. The remaining fuel injectors 140 may be fueled fuel injectors 210. By removing the flow of fuel 30 in the fuel injectors 140 within the wake or the recirculation zone 190, the possibility of fuel entrainment therein that may lead to flashback and the like may be reduced. To the extent that the flow of fuel 30 enters the wake or the recirculation zone 190, the maximum fuel-air mixture may never exceed a flammability limit for a number of given conditions because of the unfueled fuel injectors 200 therein. A position outside or downstream or otherwise out of the wake or the recirculation zone 190 thus means that the position of the fuel injector 140 is in an acceptable velocity range with respect to an overall bulk velocity in the air path 110. Other configurations and other components may be used herein.

Figure 4:
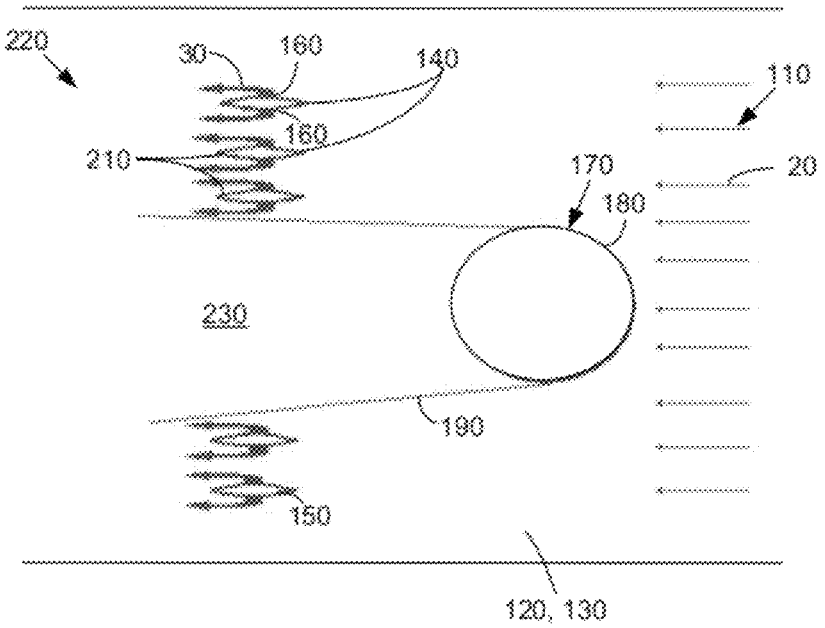
FIG. 4 is a partial schematic view of an alternative combustor as may be described herein.

FIG. 4 is an alternative embodiment of a combustor 220 as may be described herein. As above, the combustor 220 includes a number of the fuel pegs or fuel injectors 140 positioned within the air path 110. In this example, there are no fuel injectors 140 positioned downstream of the wake or the recirculation zone 190 caused by the flow obstruction 170. Rather, an unobstructed path 230 may be used. The unobstructed path 230 likewise eliminates the possibility of fuel entrainment in the wake or the recirculation zone 190 by removing the flow of fuel 30 therein. To the extent that the flow of fuel 30 enters the wake or the wake or the recirculation zone 190, the maximum fuel-air mixture may never exceed a flammability limit for a number of given conditions because of the unobstructed path 230. Other configurations and other components may be used herein.

Figure 5:
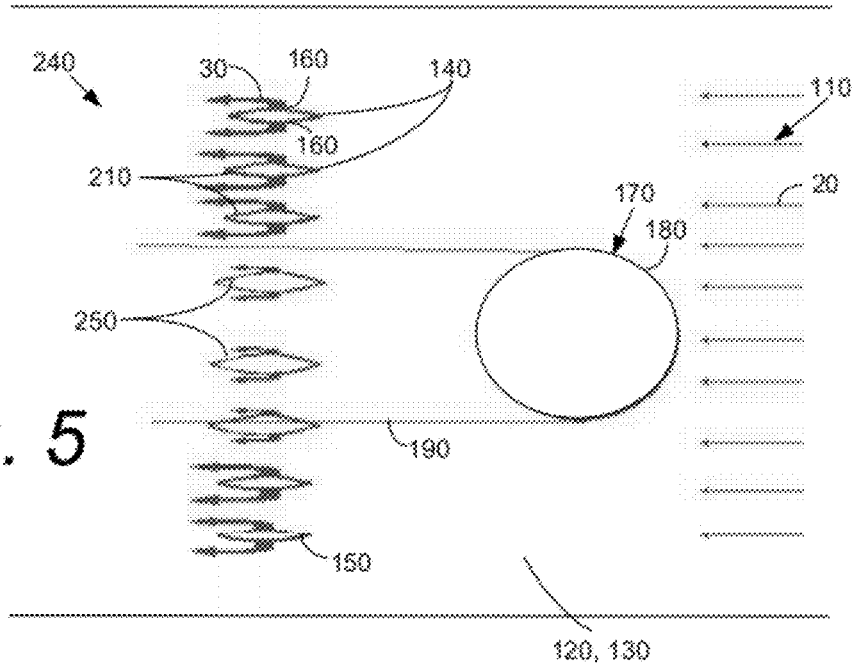
FIG. 5 is a partial schematic view of an alternative combustor as may be described herein.

FIG. 5 shows a further embodiment of a combustor 240 as may be described herein. In this example, the combustor 240 includes a number of the fuel injectors 140 positioned within the air path 110 downstream of the flow obstruction 170. In this example, a number of reduced fuel flow fuel injectors 250 may be positioned within the wake or the recirculation zone 190. Fueled fuel injectors 210 may be positioned outside of the wake or the recirculation zone 190. Reducing the flow of fuel 30 through the reduced fuel flow fuel injectors 250 within the wake or the recirculation zone 190 thus may prevent flame holding and the like because the maximum fuel-air mixture may never exceed a flammability limit for a number of given conditions. Other configurations and other components may be used herein.

Figure 6:
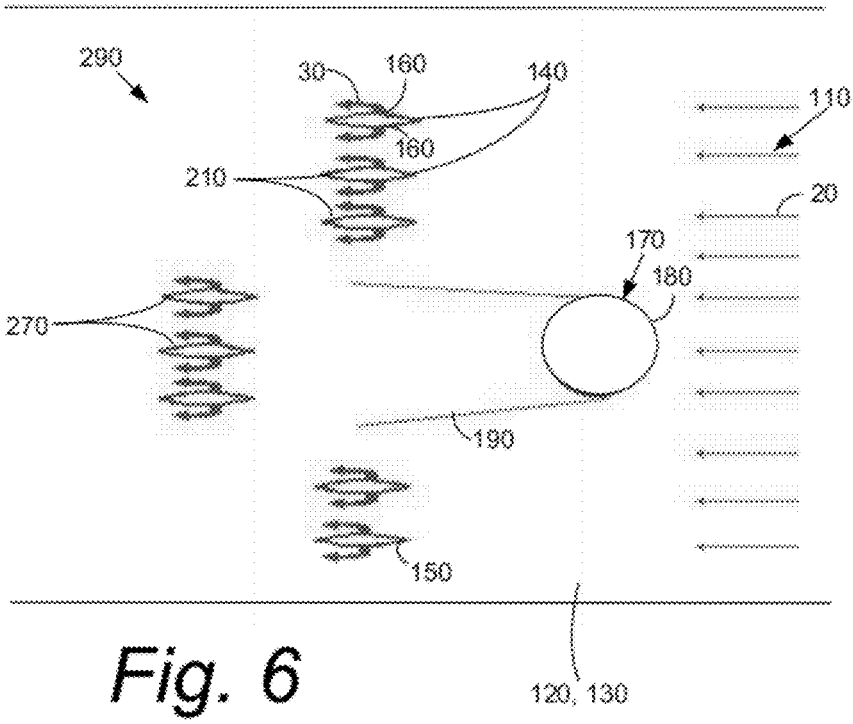
FIG. 6 is a partial schematic view of an alternative combustor as may be described herein.

FIG. 6 shows a further example of a combustor 260 as may be described herein. The combustor 260 also may include a number of the fuel injectors 140 positioned within the pathway 110 downstream of the flow obstruction 170. In this example, the fuel injectors 140 may include a number of downstream fuel injectors 270. The downstream fuel injectors 270 may be positioned further downstream from, for example, the fueled fuel injectors 210 and downstream of the wake or the recirculation zone 190 caused by the flow obstruction 170. The downstream fuel injectors 270 also may be fueled fuel injectors 210. Removing the fuel injectors 140 and the flow of fuel 30 from the wake or the recirculation zone 190 also removes the possibility of fuel entrainment while maintaining a uniform fuel profile. To the extent that the flow of fuel 30 enters the wake or the recirculation zone 190, the maximum fuel-air mixture may never exceed a flammability limit for a number of given conditions because of the lack of fuel injectors 140 therein. Other configurations and other components may be used herein.

In use, the combustors described herein thus reduce the possibility of fuel entrainment downstream of the flow obstructions 170 so as to reduce the possibility of flame holding and other types of combustion events about the fuel injectors 140. The fuel injectors 140 may vary the fuel-air ratio that could feed a wake or a recirculation zone caused by the flow obstructions 170. The fuel injectors 140 also may have an increased flame holding margin such that the overall gas turbine engine 10 may be able to use higher reactivity fuels.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A combustor, comprising:

an air flow path with a flow of air therein;

a flow obstruction positioned within the air flow path;

the flow obstruction causing a wake or a recirculation zone downstream thereof;

a first fuel injector positioned downstream and outside of the wake or the recirculation zone of the flow obstruction; and a second fuel injector, adjacent to and axially aligned with the first fuel injector, positioned downstream and in line with the flow obstruction, the second fuel injector within the wake or the recirculation zone of the flow obstruction and configured to be an unfueled fuel injector;

wherein the first fuel injector is configured to inject a flow of fuel into the air flow path at the same time that the second fuel injector is unfueled such that flows of fuel and air in the wake or the recirculation zone do not exceed a flammability limit therein; and the first and second fuel injectors comprise an airfoil-like shape, such that air flows about each side of the first and second fuel injectors.

2. The combustor of claim 1, further comprising a third fuel injector configured to inject fuel, the third fuel injector positioned adjacent to the first fuel injector and outside of the wake or the recirculation zone.

3. The combustor of claim 1, wherein the air flow path is defined by a liner and a casing.

4. The combustor of claim 1, further comprising a plurality of fuel nozzles downstream of the first and second fuel injectors.

5. The combustor of claim 1, wherein the first and second fuel injectors comprise a plurality of injector holes therein.

6. A combustor, comprising:

an air flow path with a flow of air therein;

a flow obstruction positioned within the air flow path;

the flow obstruction causing a wake or a recirculation zone downstream thereof; and a plurality of fuel injectors positioned downstream of the flow obstruction;

wherein one or more of the plurality of fuel injectors are positioned outside of the wake or the recirculation zone; and one or more of the plurality of fuel injectors are positioned within the wake or the recirculation zone and in line with the flow obstruction;

the one or more fuel injectors positioned outside of the wake or the recirculation zone are configured to inject fuel and are axially aligned with the one or more fuel injectors positioned within the wake or the recirculation zone;

the one or more fuel injectors positioned within the wake or the recirculation zone are configured to be unfueled at the same time that the one or more fuel injectors positioned outside of the wake or recirculation zone are injecting fuel; and the plurality of fuel injectors comprise an airfoil-like shape, such that air flows about each side of each of the plurality of fuel injectors.

7. The combustor of claim 6, wherein the one or more fuel injectors positioned outside of the wake or the recirculation zone inject a flow of fuel into the air flow path such that flows of fuel and air in the wake or the recirculation zone do not exceed a flammability limit therein.

8. The combustor of claim 6, wherein the air flow path is defined by a liner and a casing.

9. The combustor of claim 6, further comprising a plurality of fuel nozzles downstream of the plurality of fuel injectors.

10. The combustor of claim 6, wherein the plurality of fuel injectors each comprises a plurality of injector holes therein.

* * * * *